US006483251B2

(12) United States Patent
Setoguchi et al.

(10) Patent No.: US 6,483,251 B2
(45) Date of Patent: Nov. 19, 2002

(54) METHOD OF DRIVING PLASMA DISPLAY

(75) Inventors: Noriaki Setoguchi, Higashimorokata (JP); Takahiro Takamori, Kawasaki (JP); Tomokatsu Kishi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 09/929,364

(22) Filed: Aug. 15, 2001

(65) Prior Publication Data

US 2002/0041161 A1 Apr. 11, 2002

(30) Foreign Application Priority Data

Oct. 5, 2000 (JP) ..... 2000-306550

(51) Int. Cl.[7] ..... G09G 3/10; G09G 3/28; G09G 3/30

(52) U.S. Cl. ..... 315/169.4; 315/169.3; 345/68; 345/76; 345/77

(58) Field of Search ..... 315/169.3, 169.4; 345/60, 66, 67, 68, 76, 77, 99

(56) References Cited

U.S. PATENT DOCUMENTS 3,969,718 A * 7/1976 Strom ..... 345/68
3,987,337 A * 10/1976 Nishida et al. ..... 313/518
5,523,771 A * 6/1996 Kim ..... 345/60
6,278,436 B1 * 8/2001 Hosoi et al. ..... 345/30

FOREIGN PATENT DOCUMENTS

| | | |
|---|---|---|
| EP | 0 762 373 | 3/1997 |
| EP | 0 965 975 | 12/1999 |
| JP | 2000-75835 | 3/2000 |

* cited by examiner

*Primary Examiner*—Tan Ho
(74) *Attorney, Agent, or Firm*—Staas & Halsey LLP

(57) ABSTRACT

The method of driving the plasma display, in which a discharge for the address action is caused to occur without fail even if the voltage of the address pulse is low and its width is narrow, has been disclosed. A display frame comprises plural subframes, the gradation display is attained by combining the lit subframes, each subframe comprises the reset period, the address period, and the sustain period, the reset voltage difference applied between the first electrode and the second electrode in the reset period and the address voltage difference applied between the first electrode and the second electrode in the address period can be set arbitrarily for each subframe, and the display frame includes plural subframes in which at least the reset voltage difference or the address voltage difference is different.

5 Claims, 10 Drawing Sheets

$\Delta Vh < \Delta Vh$

METHOD OF DRIVING PLASMA DISPLAY

BACKGROUND OF THE INVENTION

The present invention relates to a method of driving a plasma display. More particularly, the present invention relates to a method of driving a plasma display in which each display frame comprises plural subframes and the gradation display is attained by the combination of the lit subframes.

The plasma display (PD) apparatus has good visibility because it generates its own light, is thin and can be made with a large-screen and high-speed display and, therefore, it is attracting interest as a replacement for the CRT display.

FIG. 1 is a diagram that shows the basic structure of a PD apparatus.

As shown in FIG. 1, in a plasma display panel (PDP) 10, X electrodes (the first electrode: sustain electrode) X1, X2, . . . , and Y electrodes (the second electrode: scan electrode) are arranged adjacently by turns and address electrodes (the third electrode) A1, A2, . . . are arranged in the direction perpendicular to that of the X and Y electrodes. A display line is formed between a pair of the X electrode and the Y electrode, that is, between X1 and Y1, X2 and Y2, and so on, and a display cell (hereinafter simply referred to as cell) is formed at the point where a display line and an address electrode intersect.

The X electrodes are commonly connected to an X sustain circuit 14, and the identical drive signal is applied to them. The Y electrodes are individually connected to a Y scan driver 12 and a scanning pulse is applied sequentially to them in the address action, which will be described later or, otherwise, the identical drive signal is applied by a Y sustain circuit 13. The address electrodes are connected to an address driver 11 and an address signal to select an ON cell and an OFF cell, in synchronization with the scanning pulse in the address action or, otherwise, the identical drive signal is applied to them. A control circuit 15 outputs a signal that controls each above-mentioned part.

FIG. 2 is a diagram that shows the structure of a frame to describe the drive sequence in the PDP apparatus. Since the discharge of the plasma display has only two states, that is, the ON state and the OFF state, the gradation of display is represented by the number of times of light emission. Therefore, a frame corresponding to a display is divided into plural subfields as shown in FIG. 2. Each subfield comprises the reset period, address period, and the sustain period. In the reset period, an action is carried out that brings all the cells, regardless whether the cell was ON or OFF in the preceding field, into a uniform state, for example, a state in which wall charges are eliminated or wall charges are formed uniformly. In the address period, a selective discharge (address discharge) is carried out in order to determine whether a cell is in the ON or OFF state according to the display data and wall charges needed to cause a discharge for light emission to occur in the subsequent sustain period are formed on a cell in the ON state. In the sustain period, a discharge is carried out repeatedly for light emission in the cell put into the ON state in the address period. The length of the sustain period, that is, the number of times of light emission differs from subfield to subfield, and the gradation of display can be represented by setting the numbers of times of light emission to a ratio of, for example, 1:2:4:8 . . . , and combining subfields to emit light for each cell according to the gradation.

FIG. 3 is a waveform chart that shows an example of the conventional method of driving a plasma display panel. As shown schematically, in the reset period, a pulse of the voltage Vw greater than the discharge start voltage, 300 V for example, is applied to the X electrode. The application of this pulse causes a discharge to occur in every cell regardless whether the cell was ON or OFF in the preceding subfield and wall charges are formed. When this pulse is removed, a discharge is caused to occur again by the voltage due to the wall charges themselves, and because there is no potential difference between electrodes, the space charges generated by the discharge are neutralized and a uniform state without a wall charge is realized. In the address period, a scanning pulse is applied sequentially to the Y electrode and an address pulse (address signal) is applied to the address electrode of the cell to be lit of the display line to cause a discharge to occur. This discharge propagates to the X electrode side and wall charges are formed between the X electrode and the Y electrode. This scanning is performed to the entire display line. In the address period, it is required that a discharge is caused to occur in the cell to which an address pulse is applied, and not in the cell to which an address pulse is not applied, and the voltage of the address pulse is determined with various error factors being taken into account. Then, in the sustain period, a sustaining pulse of the voltage Vs (approx. 170 V) is applied repeatedly to the X electrode and the Y electrode. When the sustaining pulse is applied, the cell in which wall charges are formed in the address period takes place a discharge because the voltage due to the wall charges is superposed on that of the sustaining pulse and the total voltage exceeds the discharge start voltage. The cell, in which no wall charge is formed in the address period, does not discharge. Although almost all charges are neutralized, a certain amount of ions and metastable atoms remains in the discharge space. It may be a case in which these remaining charges are used to act as a priming to cause an address discharge without fail for the next address discharge. This is called, in general, the pilot effect or the priming effect.

FIG. 4 is a diagram that shows another example of a conventional driving method disclosed in Japanese Unexamined Patent Publication (Kokai) No. 2000-75835 by the present applicant. This driving method can cause a weak reset discharge to occur and prevent the contrast from deteriorating due to the reset discharge by designing the reset pulse with a slope waveform in which voltage changes gradually. In addition, Japanese Unexamined Patent Publication (Kokai) No.2000-75835 has disclosed that it is possible to make an amount of wall charges accumulate by adjusting the voltage applied between the X electrode and the Y electrode when the reset period is completed, and it is also possible to cause a stable address discharge to occur by setting the voltage with the slope waveform to be applied to the Y electrode to a voltage between the voltage when the scanning pulse is not applied and that of the scanning pulse in the address period.

The basic structure and action of the plasma display apparatus are described as above, but various examples of modification have been proposed. In one of the modifications, for example, plural subfields with the same number of times of light emission are provided in the frame structure as shown in FIG. 2 to make an animation display smooth. In another modification, a reset action accompanied by write discharge is carried out only in the first subfield of a frame and not in the reset action of the subsequent subfields. In another modification, a reset is carried out not in all the cells but only in the cells that were ON in the preceding subfield. In another modification, uniform wall charges are left in the reset action and the erasing address method may be used to select cells that are OFF to eliminate wall charges in the address action. In another modification, a desired amount of charges is left to be utilized in the address action by applying a voltage between the X electrode and the Y electrode from which the reset pulse is removed. Moreover, the present applicant has disclosed the plasma display apparatus employing a method called the ALIS method, in which the number of display lines is doubled without changing the number of the X electrode and the Y electrode by forming display lines in every slit between the X electrode and the Y electrode, that is, between each Y electrode and both X electrodes on both sides, in EP 0 762 373 A2.

As explained so far, there are various modifications of the plasma display apparatus, and the present invention can be applied to every one of them.

A high quality display, which exceeds that of a CRT, is required of the plasma display apparatus. The factors that will realize the high quality of display include the high definition, the high gradation, the high brightness, the high contrast, and so on. To achieve a high definition, it is necessary to increase the numbers of display lines and display cells by narrowing the pixel pitch, and the above-mentioned ALIS method has a structure that enables the realization of a high definition at a low cost. To achieve a high contrast, it is necessary to decrease the intensity and the number of times of discharges of such as the reset pulse, which has no relation to the display.

To achieve a high gradation, it is necessary to increase the number of subfields in the frame to increase the number of gradations that can be represented, but this also requires that the time required for the reset action and the address action be abbreviated or the period of the sustaining discharge be abbreviated. To achieve a high brightness, it may be a measure that the intensity of a sustaining discharge is increased, but this will lead to a problem in that the fluorescent materials are degraded. Another measure may be that the number of times of sustaining discharge in the frame is increased. To increase the number of times of sustaining discharge, it is necessary to abbreviate the period of sustaining discharge or increase the ratio of the sustaining period by abbreviating the time required for the reset action and the address action as described above. The abbreviation of the sustaining action period is, however, has its own limit in the current structure because a stable occurrence of sustaining discharge must be maintained. Therefore, from the viewpoint of the higher gradation and brightness, the abbreviation of time of the reset action and the address action is required. Particularly, the address period is longer than the reset period because a scanning pulse is applied sequentially, therefore, if the scan pulse can be narrowed, the effect resulting from the reduction of time will be large.

The voltage between the address electrode and the Y electrode in the address action is the difference in voltage between the address pulse and the scanning pulse (or the voltage added by the effective voltage due to the wall charges formed in the reset period), and a discharge is caused to occur when the effective voltage exceeds the discharge threshold voltage. If the difference between this effective voltage and the discharge threshold voltage is large, the width of the scanning pulse can be made narrow because the time lag before the address discharge is short and, if the difference is small, the width of the scanning pulse needs to be widened because the time lag before the address discharge is long. That is, the relation between the effective voltage between the address electrode and the Y electrode and the width of the scanning pulse is a trade-off. Therefore, one method to cause the action with a narrow scanning pulse is to increase the difference in voltage between the address pulse and the scanning pulse.

Taking various error factors into account, it is necessary to determine the voltage of address pulse so that an address discharge is caused to occur in the cell to which an address pulse is applied, and not in the cell to which an address pulse is not applied. More concretely, the voltage of address pulse is set to a voltage greater than the variations of the effective voltage to be applied to each cell, and the voltage of scanning pulse (and the effective voltage due to the wall charges formed in the reset period) is determined so that the discharge threshold voltage is reached when the half of the voltage of address pulse is applied. The scanning pulse depends largely on the voltage difference from that of the address pulse, and if the address pulse has a positive polarity, the scanning pulse has a negative polarity. As described above, it is necessary, for example, to decrease the voltage of the scanning pulse to increase the difference voltage, but in this case, a problem relating to the pressure tightness of the Y electrode is brought forth.

Therefore, it may be recommended to leave wall charges effective for the next address action in the reset period so that the voltage difference between the address pulse and the scanning pulse is increased effectively by utilizing the voltage due to the residual wall charges.

Taking the above-mentioned points into account, the voltage of address pulse, the voltage and the width of scanning pulse, and the amount of the wall charges to be left in the reset period are determined so that the address discharge according to the display data takes place without fail.

In the plasma display apparatus, a subframe structure as shown in FIG. 2 is provided to represent gradation, and subframes to be put into the ON state according to the display level are selected for each cell. Generally, the conditions about the voltage of address pulse, the voltage and the width of scanning pulse, and the amount of wall charges to be left in the reset period used to be identical in all the subframes.

If, however, the identical conditions are provided for each subframe in the reset period and the address period, the time lag before the occurrence of address discharge differs from subframe to subframe. This time lag before the occurrence of address discharge is caused because the priming effect is not sufficient, and address discharge is made more unlikely to take place. As described above, the charges generated by the discharge are accumulated as wall charges or are neutralized, but a certain amount of ions and metastable atoms remains in the discharge space, providing the priming effect. The charges in the discharge space are generated according to the intensity of the discharge and are neutralized gradually and disappear. Therefore, in the case where a largely-weighted subframe is lit, the priming effect with a considerable magnitude can be expected because of many sustain discharges, but when a slightly-weighted subframe is lit, the priming effect appears only slightly because the number of times of sustaining discharge is small. Moreover, the priming effect dwindles, after the discharge, as time goes by. Therefore, in the case where the period of dark display is long, the priming effect of the subframe is small because only slightly-weighted subframes in each frame are lit, dwindles because there is no subframe to be lit until the next frame, and becomes very small by the time of the address period of the subframe in the next frame, and the address discharge is made more unlikely to take place.

Conventionally, the conditions of the voltage of the address pulse, the voltage and the width of the scanning pulse, the amount of the wall charges to be left in the reset period, and so on, used to be determined in order to cause the address action to take place without fail even in such case. Because the difference in each frame increases the variations in the effective voltage in the address action, the voltage of the address pulse used to be increased or the width of the scanning pulse used to be widened accordingly to increase the range of allowance. It is, however, necessary to employ an address driver of high voltage resistance when the voltage of the address pulse is increased, and this will result in a problem that the cost is raised. On the other hand, when the width of scanning pulse is widened, a problem in that the address period is lengthened is brought forth.

As described above, such method that satisfies both conditions that the voltage of the address pulse is lowered and that the width of the scanning pulse is narrowed has not been employed until now.

SUMMARY OF THE INVENTION

The object of the present invention is to realize a method of driving a plasma display in which a discharge is caused to occur without fail for the address action even if the voltage of the address pulse is low and the width of the scanning pulse is narrow.

The method of driving a plasma display of the present invention is one in which the voltage, which is applied between the first electrode (x electrode) and the second electrode (Y electrode), is varied to make a difference in voltage in order to leave wall charges in the reset period, and to realize the above-mentioned object, the difference in the reset voltage, which is applied between the first electrode and the second electrode in the reset period, and that of the address voltage, which is applied between the first electrode and the second electrode in the address period, can be set to an arbitrary value for each subframe, and at least either one of the difference in the reset voltage or that in the address voltage differs from others at least in a subframe.

The difference in the reset voltage, which is applied between the first electrode and the second electrode in the reset period, affects the amount of wall charges to be left in the reset period. The sum of the address voltage difference and the voltage due to the wall charges is the effective voltage, which is applied between the first electrode and the second electrode in the address action. According to the present invention, the address voltage difference, which is applied between the first electrode and the second electrode in the address period, or the amount of wall charges to be left in the reset period, or both (i.e. the effective voltage), can be set to an optimum value for each subframe. Therefore, it is no longer necessary to take into account the time lag before the address discharge in the subframe, which used to be done, and the width of the scanning pulse can be narrowed in every subframe, resulting in a reduction in the time required for the address period.

The effective voltage in the address action is made larger in the subframe with a shorter sustain period than in that with a longer sustain period. When the frame reset period, in which a reset discharge is performed on the entire surface of the display frame, is provided at the beginning of the frame, the effective voltage in the address action is made larger in the subframe further from the frame reset period than in the subframe nearer to the frame reset period.

In addition, it may be a case in which the width of the scanning pulse, as well as the effective voltage in the address action, is set for each frame.

The driving method of the present invention is a method in which a desired amount of wall charges is left by changing the voltage at the end of a slope pulse, which is applied between the first electrode and the second electrode in the reset period. To change the voltage at the end, a circuit is employed in which the slope pulse is generated and the output voltage changes as time goes by, and the time of driving the circuit is controlled.

BRIEF DESCRIPTION OF THE DRAWINGS

The present invention will be more clearly understood from the description as set below, with reference to the accompanying drawings, wherein.

DESCRIPTION OF THE PREFERRED EMBODIMENTS

Figure 1:
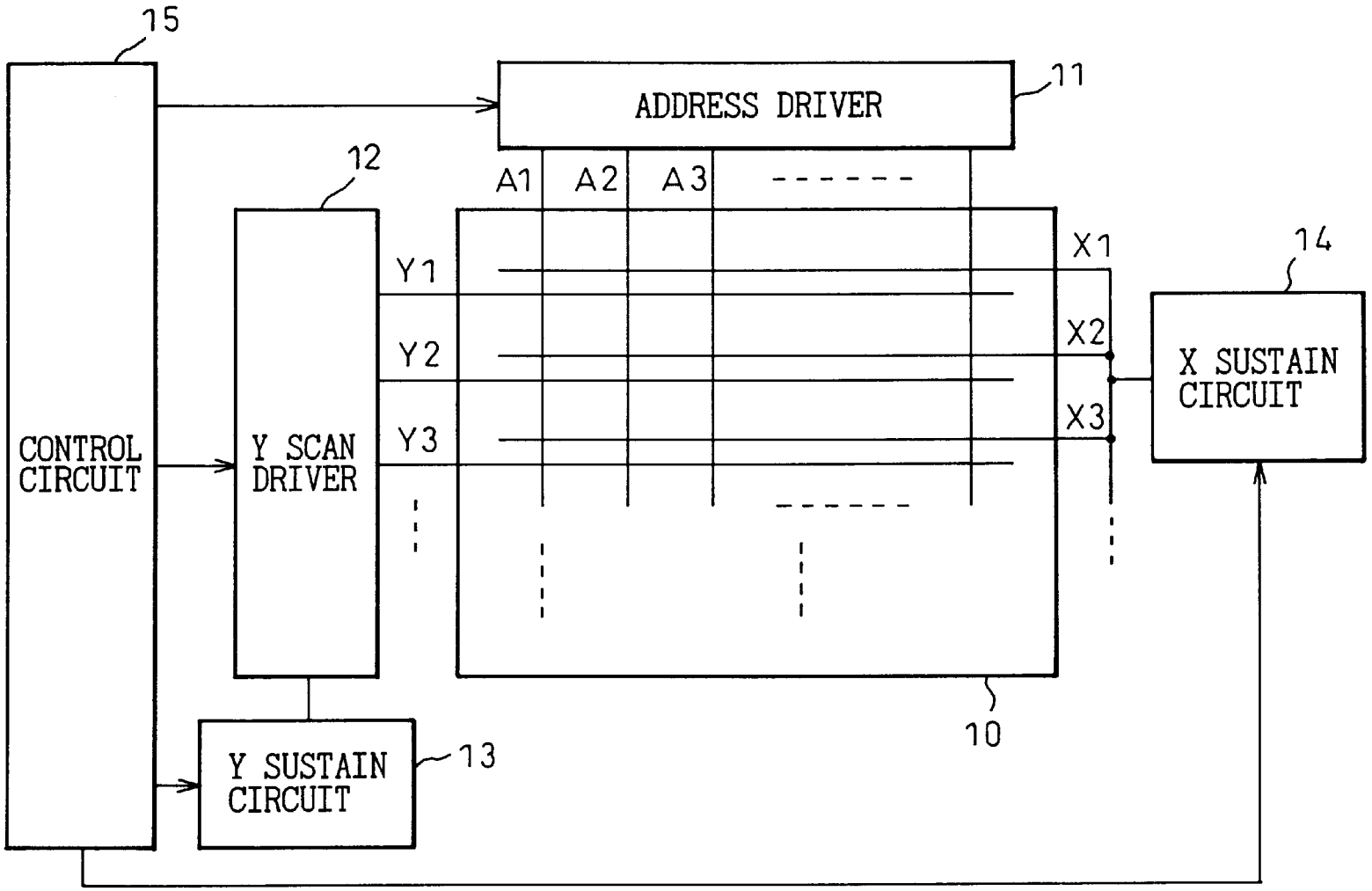
FIG. 1 is a block diagram that shows the basic structure of the plasma display apparatus.
Figure 2:
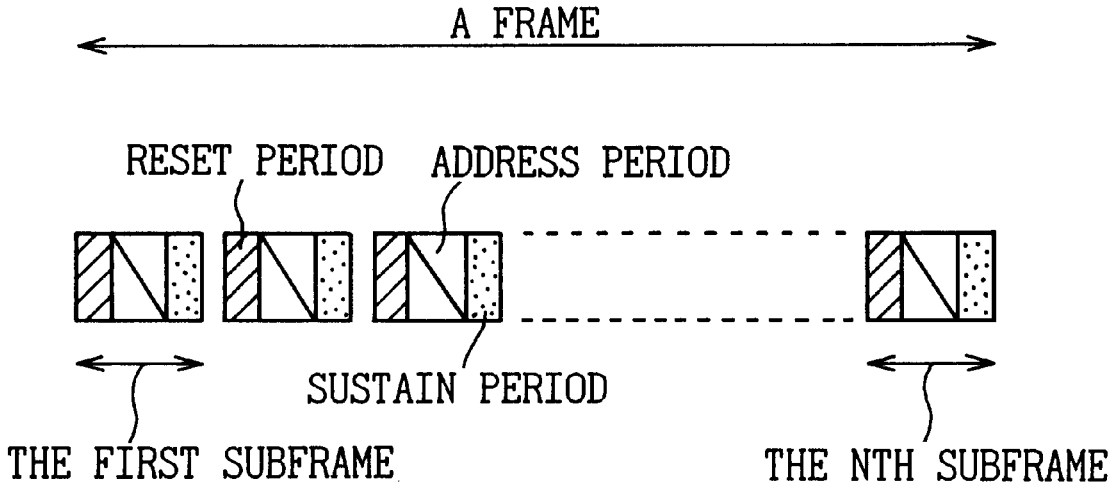
FIG. 2 is a diagram that shows the frame structure to perform the gradation display in the plasma display apparatus.
Figure 3:
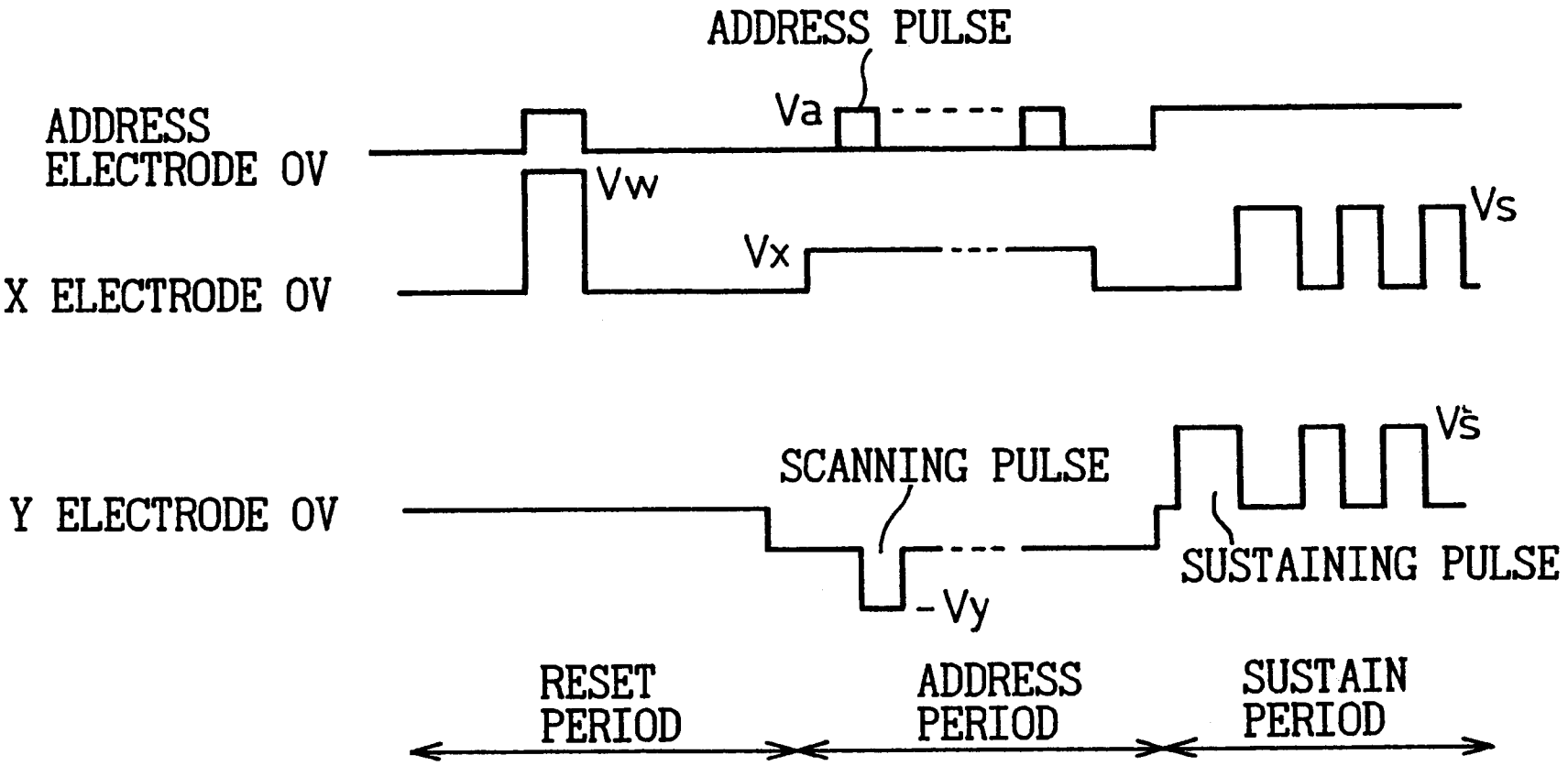
Fig.3 PRIOR ART
FIG. 3 is a waveform chart that shows the conventional method of driving the plasma display apparatus.
Figure 4:
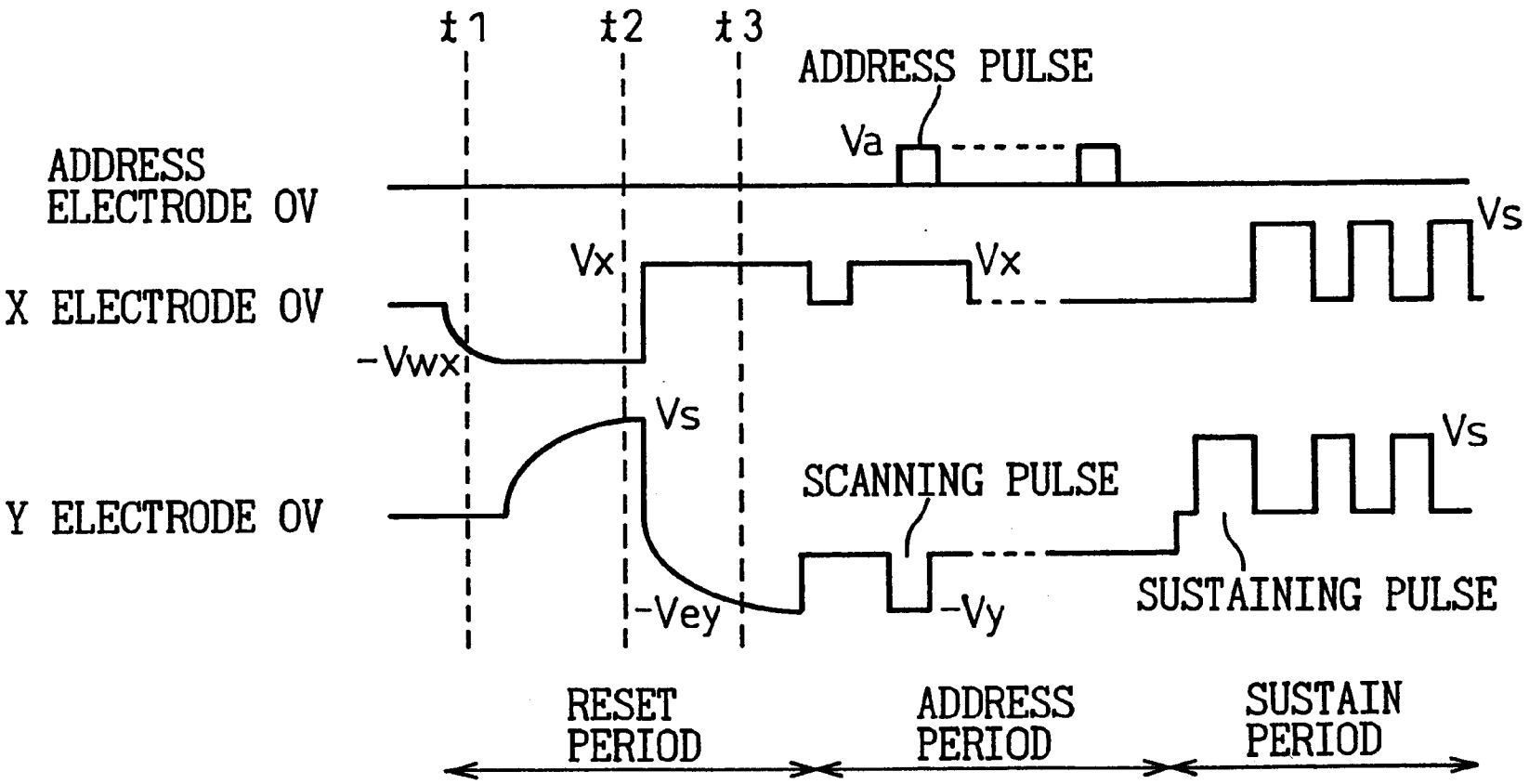
Fig.4 PRIOR ART
FIG. 4 is a waveform chart that shows another conventional method of driving the plasma display apparatus.
Figure 5:
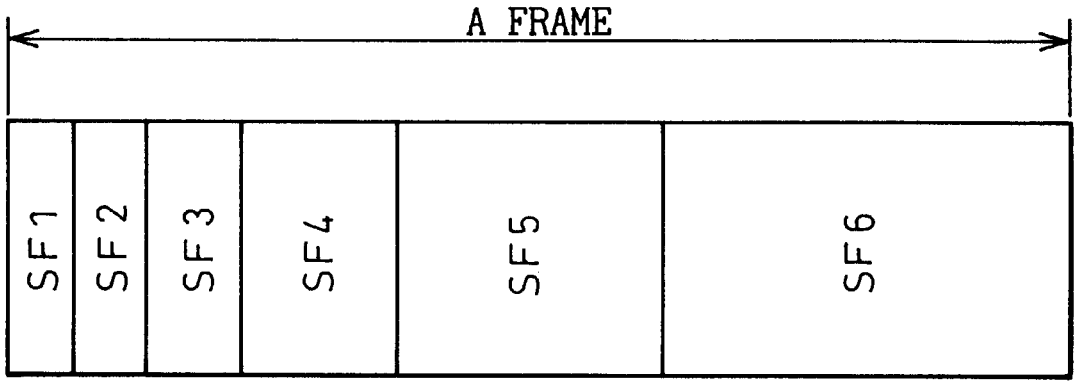
FIG. 5 is a diagram that shows the frame structure in the first embodiment of the present invention.

FIG. 5 is a diagram that shows the frame structure in the first embodiment of the present invention. As shown schematically, in a frame, six subframes, that is, subframe 1 (SF1), SF2, . . . , SF6, are arranged in order and the sustain period in each subframe is longer in SF2 than in SF1, longer in SF3 than in SF2, . . . , and longer in SF6 than in SF5.

Figure 6:
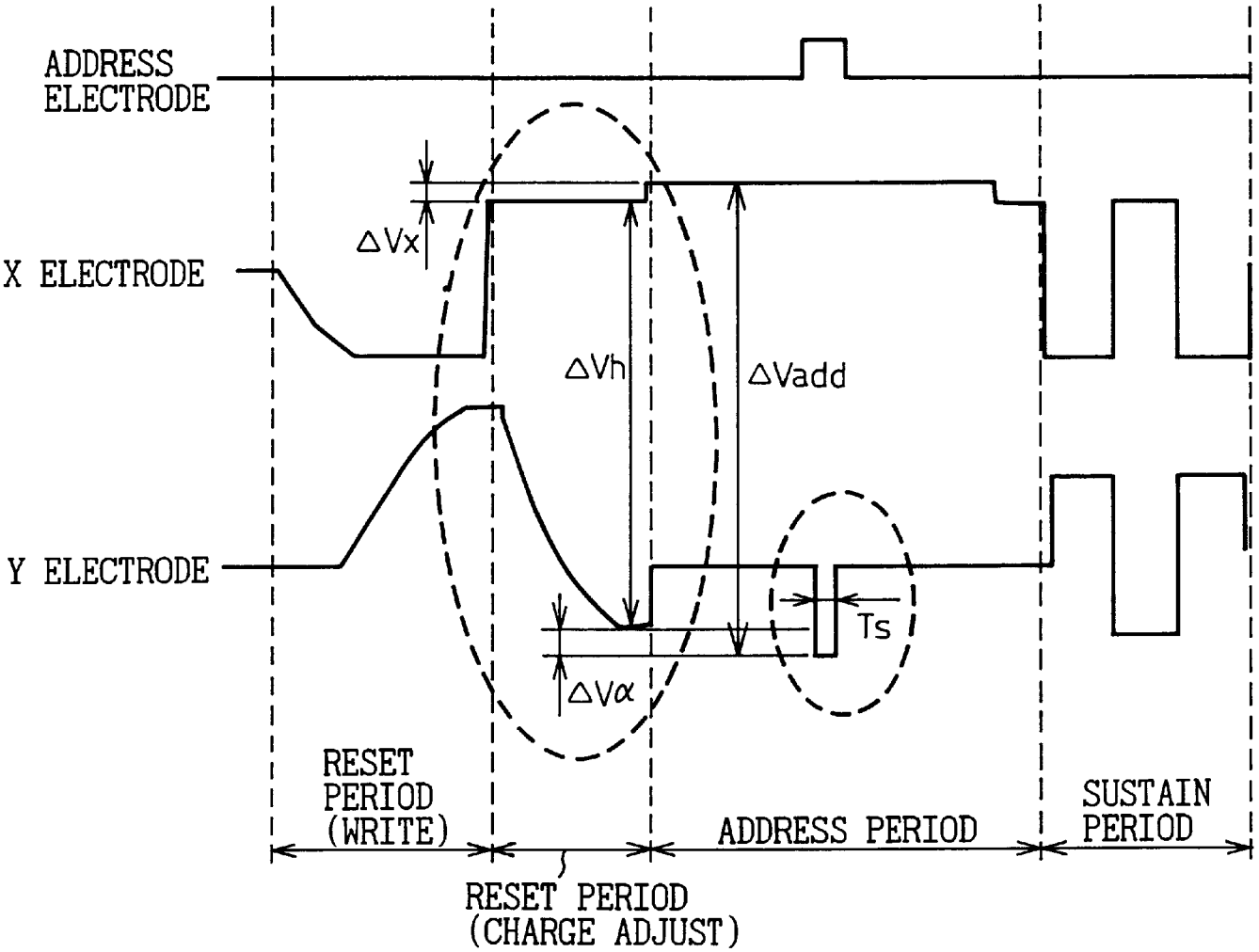
FIG. 6 is a waveform chart that shows the driving method in the first embodiment.

FIG. 6 is a diagram that shows the drive waveform in each subframe in the first embodiment, and the length of the sustaining period (i.e. the number of sustaining pulses) differs from subfield to subfield, and at the same time $\Delta Vadd-\Delta Vh$ is set arbitrarily.

As shown schematically, the reset period in each SF is divided into the two periods, that is, the reset period (write) and the reset period (charge adjust). In the reset period (write), the reset discharge is caused to occur by applying the slope pulse, whose voltage drops gradually, to the X electrode, and that, whose voltage increases gradually, to the Y electrode. Due to the reset discharge, positive charges accumulate on the X electrode side and negative charges accumulate on the Y electrode side. The discharge due to the slope pulse, however, is small and has an advantages in that the amount of unwanted light emission due to the reset discharge can be reduced. However, the priming effect caused by the reset discharge due to the slope pulse is very small and the sufficient priming effect cannot be expected. Therefore, the priming effect caused by the sustaining discharge will be essential for the address discharge in the subsequent address period.

Figure 7:
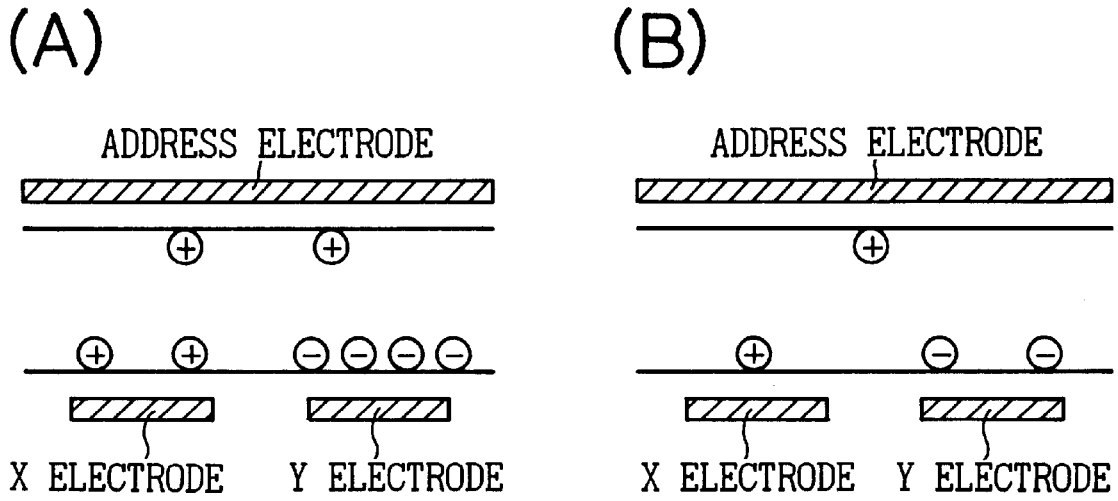
FIG. 7 is a diagram that shows the wall charges on each electrode after the reset period is completed in the first embodiment.

In the subsequent reset period (charge adjust), a specified voltage (the same voltage as that of the positive side of the sustaining pulse) is applied to the X electrode, and the slope pulse, whose voltage drops gradually, to the Y electrode to decrease the wall charges accumulated in the preceding reset period (write). At this time, the voltage applied to the X electrode is greater than that applied to the X electrode, and the voltage difference is ΔVh. As disclosed in the above-mentioned Japanese Unexamined Patent Publication (Kokai) No. 2000-75835, there exists a fixed relation between the voltage difference ΔVh and the amount of residual wall charges, and the amount of wall charges is increased when the voltage difference ΔVh is decreased. Moreover, because the wall charges accumulated in the reset period (write) are decreased in the reset period (charge adjust), the intensity of the reset discharge in the reset period (write) also had relation to the amount of the residual wall charges after the reset period (charge adjust) is completed. The intensity of the reset discharge has relation to the voltages of the X electrode and the Y electrode in the reset period (write). In either case, at the end of the reset period (write), negative charges accumulate on the Y electrode, and positive charges accumulate on the X electrode and the address electrode as shown in FIG. 7. The amount of accumulated charges is large when ΔVh is small, or the voltage difference between the X electrode and the Y electrode in the reset period (write) is large.

In the subsequent address period, a voltage higher by ΔVx than the above-mentioned fixed voltage (the same voltage as that on the positive side of the sustaining pulse) is applied to the X electrode and, after the intermediate voltage of the sustaining pulse is applied, a scanning pulse with width Ts is applied sequentially to the Y electrode. The voltage difference between the X electrode and the Y electrode when a scanning pulse is applied is ΔVadd. The voltage of the scanning pulse is lower by ΔVα than that of the slope pulse applied to the Y electrode at the end of the reset period (charge adjust). In addition, in synchronization with the application of the scanning pulse, an address pulse is applied to the address electrode. The effective voltage applied between the X electrode and the Y electrode during address discharge is the voltage ΔVadd superposed by that due to the wall charges. As mentioned above, the voltage due to wall charges has relation to ΔVh, therefore, the effective voltage applied between the x electrode and the Y electrode during address discharge has relation to ΔVadd−Δvh. That is, the larger ΔVadd−ΔVh, the more likely address discharge is caused to occur. Because the subsequent sustain period is identical to that of the conventional one, a description is omitted here.

As mentioned above, some charges generated by a discharge remain in the discharge space, providing the priming effect. In the first embodiment, the priming effect due to the reset discharge in the reset period (write) is small as shown above, therefore, the priming effect due to the sustaining discharge will be the main problem to be focused on. When a largely-weighted subframe is lit, a considerable priming effect is generated because of many of sustaining discharges. Therefore, when a largely-weighted subframe is lit, the priming effect remains not only in the contiguous slightly-weighted subframe but also in the largely-weighted subframe in the subsequent frame, so this case does not bring forth any problem concerning the priming effect. On the contrary, when only a slightly-weighted subframe is lit, the priming effect is weak and becomes very slight before a slightly-weighted subframe in the subsequent frame is lit. Therefore, it is the slightly-weighted subframe that shows a problem concerning the reduction of the priming effect.

In the first embodiment, Δvadd−Δvh in a slightly-weighted subframe SF1 or SF2 is made larger than that in a largely-weighted subframe SF5 or SF6, in order to cause the address discharge to occur more often. In addition, there may be a case where the voltage between the X electrode and the Y electrode in the reset period (write) is made large. This ensures the address discharge to occur without fail even when only slightly-weighted subframes are lit and the priming effect is weak.

In FIG. 6, the sum of the voltage difference ΔVx, between the voltage applied to the X electrode in the reset period (charge adjust) and that applied to the X electrode in the address period, and the voltage difference ΔVα, between the voltage (voltage at the end of the slope pulse) applied to the Y electrode at the end of the reset period (charge adjust) and that of the scanning pulse applied to the Y electrode in the address period, is equal to ΔVadd−ΔVh, in other words, ΔVadd−Δvh=ΔVx+ΔVα. When increasing ΔVadd−ΔVh, the same effect can be obtained by increasing ΔVx or ΔVα. Moreover, the amount of the wall charges to be left on the address electrode in the address action can be adjusted by the distribution ratio of ΔVx and ΔVα.

Figure 8A:
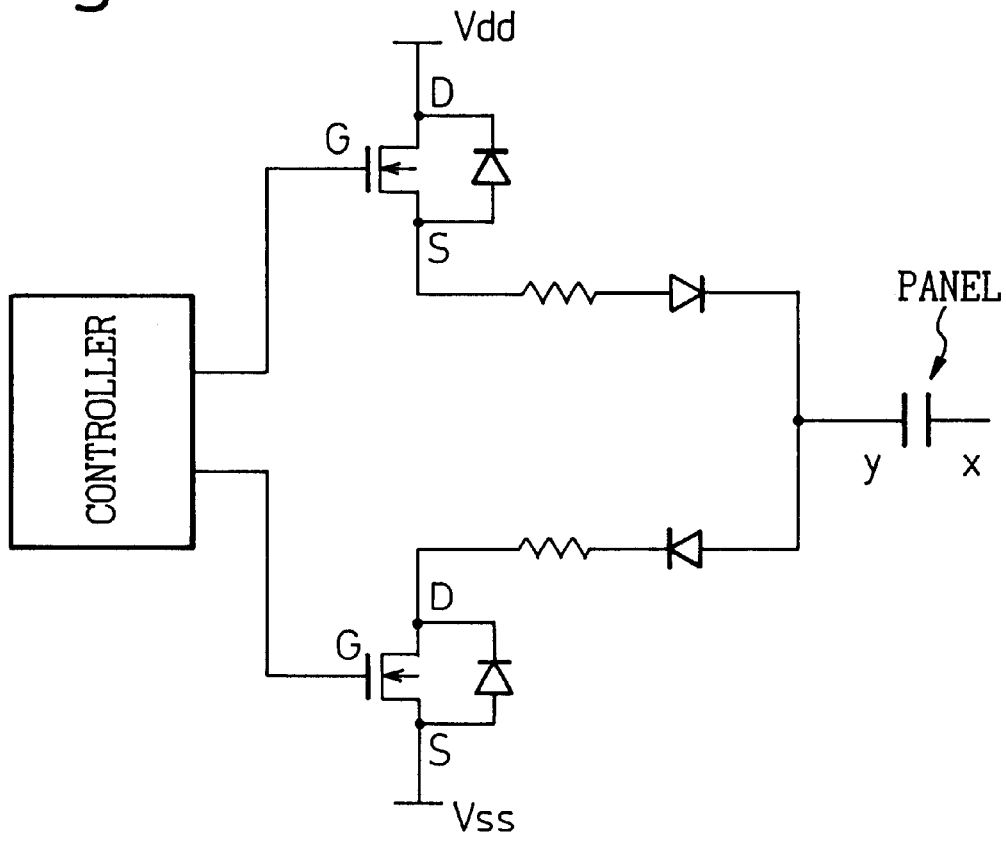
FIG. 8A is a diagram that shows the structure of the slope pulse generating circuit used in the first embodiment.
Figure 8B:
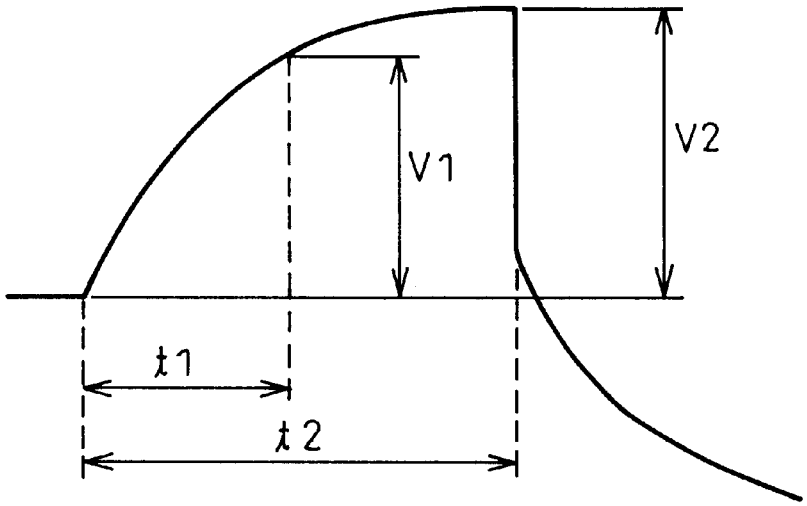
FIG. 8B is a diagram that illustrates the operation of the slope pulse generating circuit used in the first embodiment.

In the first embodiment, it is necessary to apply the slope pulse to the electrode in the reset period (write) and the reset period (charge adjust), and also necessary to change the voltage at the end of the application of the slope pulse according to the subframe. FIG. 8A is a diagram that shows the structure of the slope pulse generating circuit to generate such slope pulses, and also FIG. 8 illustrates the action of the circuit. As shown in FIG. 8A, the drain of the first FET is connected to the terminal of the first power source, the gate to the controller, and the source to the output via a resistor and a diode. The Y electrode, that is, the output, is connected to the terminal of the second power source via a diode, a resistor, and the second FET. The first power supply is one that supplies a slightly higher voltage than the target voltage of the positive slope waveform, and the second power supply is one that supplies a slightly lower voltage than the target voltage of the negative slope waveform. When a positive slope pulse is applied, the pulse that turns the first FET on is applied while the signal that turns the second FET off is being output from the controller. In the controller, the width of this pulse can be set arbitrarily. The output increases gradually when the FET turns on because the resistor and the panel capacitance form the delay circuit. The output is maintained at the desired voltage if the output of the pulse to be applied to the first FET gate is terminated from the controller when the output reaches the desired voltage. For example, as shown in FIG. 8B, if the output is terminated at the voltage V1, the controller puts out the pulse with the width t1, and if terminated at the voltage V2, the controller puts out the pulse with the width t2. Thus, the voltage of the positive slope pulse at the end can be set arbitrarily. When a negative slope pulse is applied, the second FET is activated in the same way as mentioned above. Thus, a signal combining the two slope pulses to be applied to the Y electrode in FIG. 6 is generated.

Figure 9:
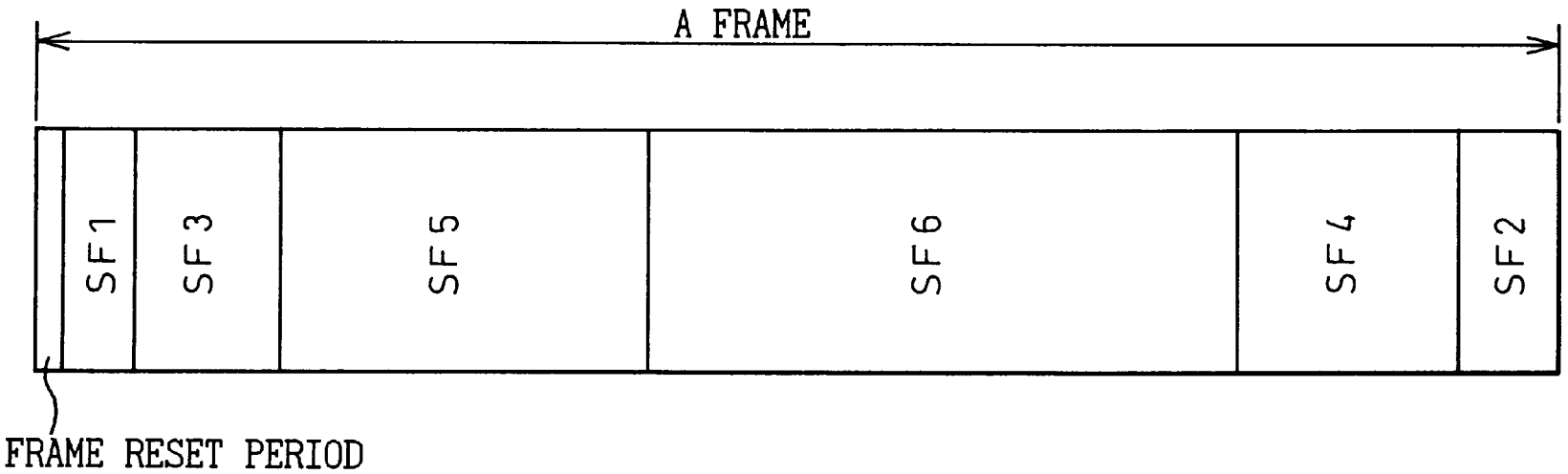
FIG. 9 is a diagram that shows the frame structure in the second embodiment of the present invention.

FIG. 9 is a diagram that shows the frame structure in the second embodiment of the present invention. In the frame structure of the second embodiment, the most largely-weighted subframe is arranged in the center of the frame and less largely-weighted subframes are arranged in order toward both directions and, at the same time, the frame reset period is provided at the top of the frame. In this frame reset period, regardless of the state when the preceding subframe is completed, a reset discharge is caused to occur on the entire surface (all cells), and conventional entire surface write pulses or the slope pulses can be used. The priming is formed by this reset discharge.

Figure 10:
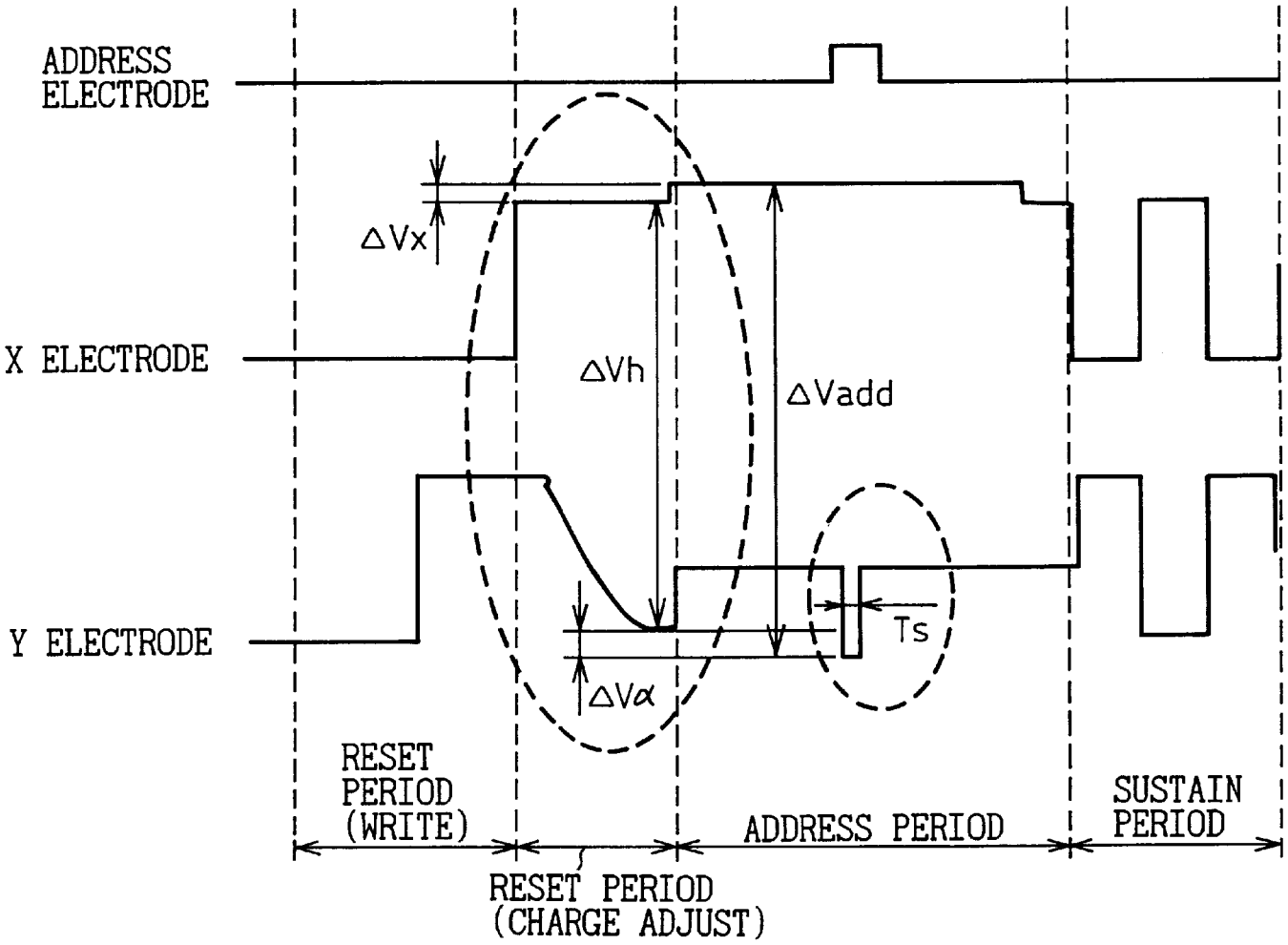
FIG. 10 is a waveform chart that shows the driving method in the second embodiment.

FIG. 10 is a diagram that shows the drive waveforms of each subframe in the second embodiment, and the drive waveforms differ from those in the first embodiment in FIG. 6 in that a pulse that changes abruptly is applied in the reset period (write). A reset discharge is caused to occur even if such a pulse is applied. The subsequent actions are identical to that in the first embodiment, but in the second embodiment, ΔVadd−ΔVh in the subframe SF4 or SF2, which is far away from the frame reset period, or the voltage between the X electrode and the Y electrode in the reset period (write) is made larger than ΔVadd−ΔVh in other subframe SF1 or SF6, so that the address discharge is made more likely to occur. By this, even when the priming effect is weak in the subframes away from the frame reset period, the address discharge is ensured to occur without fail.

As described above, according to the present invention, because the effective voltage in the address period can be set to the optimum state according to the subframe, the operation margin becomes larger and the address period can be abbreviated by narrowing the width of the scanning pulse. This will further improve the quality of gradation and brightness of the plasma display apparatus.

We claim:

1. A method of driving a plasma display, comprising first electrodes and second electrodes arranged adjacently by turns, and third electrodes arranged so as to intersect said first and second electrodes, wherein display cells are formed at the points where said first and second electrodes intersect said third electrode, wherein a display frame corresponding to a display comprises plural subframes and the gradation displayed is attained by combining lit subframes; each subframe comprises a reset period during which the distribution of wall charges of a display cell is initialized, an address period during which the wall charges of said display cell are put into a state according to the display data after said reset period, and a sustain period during which a cell to be lit is selectively made to emit light according to the state of said display cell set in said address period; and the reset voltage difference to be applied between said first electrode and said second electrode in said reset period, and the address voltage difference to be applied between said first electrode and said second electrode in said address period, can be set for each subframe, and the display frame includes plural subframes in which at least either said reset voltage difference or said address voltage difference is different.

2. A method of driving a plasma display as set forth in claim 1, wherein at least either said reset voltage difference or said address voltage difference is larger in a subframe said sustain period of which is shorter than in a subframe said sustain period of which is longer.

3. A method of driving a plasma display as set forth in claim 1, wherein: each display frame comprises a frame reset period, during which a reset discharge is caused to occur on the entire surface, regardless of the state at the end of the preceding frame, is provided at the top of said frame; and at least either said reset voltage difference or said address voltage difference is larger in a subframe further away from said frame reset period than in a subframe nearer to said frame reset period.

4. A method of driving a plasma display as set forth in claim 1, wherein: in said address period, while a scanning pulse is applied sequentially to said second electrode, a signal corresponding to the display data is applied to said third electrode in synchronization with said scanning pulse; the width of said scanning pulse can be set for each subframe; and said reset voltage difference and said address voltage difference can be set for each subframe according to the width of said scanning pulse.

5. A method of driving a plasma display as set forth in claim 1, wherein, a signal to be applied between said first electrode and said second electrode in said reset period changes in voltage over time and said signal is realized by controlling the drive time of a circuit in which the output voltage changes over time.

* * * * *